US010782106B2

(12) United States Patent
Boulanger et al.

(10) Patent No.: US 10,782,106 B2
(45) Date of Patent: Sep. 22, 2020

(54) SHAPED CHARGE

(71) Applicant: NEXTER MUNITIONS, Versailles (FR)

(72) Inventors: Rémi Boulanger, Bourges (FR); Bertrand Padiolleau, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 16/627,512

(22) PCT Filed: Jun. 25, 2018

(86) PCT No.: PCT/EP2018/066983

§ 371 (c)(1),
(2) Date: Dec. 30, 2019

(87) PCT Pub. No.: WO2019/002219

PCT Pub. Date: Jan. 3, 2019

(65) Prior Publication Data

US 2020/0158479 A1 May 21, 2020

(30) Foreign Application Priority Data

Jun. 28, 2017 (FR) ..... 17 00705

(51) Int. Cl.
*F42B 1/028* (2006.01)
*F42B 1/036* (2006.01)

(52) U.S. Cl.
CPC ..... *F42B 1/028* (2013.01); *F42B 1/036* (2013.01)

(58) Field of Classification Search
CPC .. F42B 1/02; F42B 1/028; F42B 1/036; F42B 12/10
See application file for complete search history.

(56) References Cited

U.S. PATENT DOCUMENTS 5,153,373 A 10/1992 Lips et al.
5,351,622 A * 10/1994 Ekholm ..... F42B 1/036 102/476

(Continued)

FOREIGN PATENT DOCUMENTS

EP 0491587 A1 * 6/1992 ..... F42B 12/10
EP 0 773 423 A1 5/1997

(Continued)

OTHER PUBLICATIONS

Oct. 19, 2018 International Search Report issued in International Patent Application No. PCT/EP2018/066983.

(Continued)

*Primary Examiner* — Joshua T Semick
(74) *Attorney, Agent, or Firm* — Oliff PLC

(57) ABSTRACT

A shaped charge including an explosive load positioned in a casing, a liner applied on the load, and means ensuring the securing of the casing and the load bearing the liner. These securing means include a ring having a stop surface for the liner and at least two shims each covering an angular sector and moving radially by the action of a tightening means, to be pressed against an inner bearing surface of the casing. According to the invention, the tapped hole of the tightening screw(s) has its axis parallel to the axis of the casing and the shim is positioned axially relative to the ring by at least one radial pin authorizing sliding thereof.

9 Claims, 2 Drawing Sheets

(56) References Cited

U.S. PATENT DOCUMENTS

| | | | | |
|---|---|---|---|---|
| 5,522,319 | A * | 6/1996 | Haselman, Jr. | F42B 1/028 102/306 |
| 6,035,785 | A | 3/2000 | Sabathier et al. | |
| 7,150,231 | B2 * | 12/2006 | Olofsson | F42B 1/02 102/481 |

FOREIGN PATENT DOCUMENTS

| | | | | |
|---|---|---|---|---|
| EP | 0 857 938 | A1 | 8/1998 | |
| EP | 1 363 102 | A2 | 11/2003 | |
| EP | 1 363 103 | A1 | 11/2003 | |
| FR | 2 669 721 | B1 | 1/1993 | |
| FR | 2839777 | A1 * | 11/2003 | F42B 1/036 |

OTHER PUBLICATIONS

Oct. 19, 2018 Written Opinion of the International Preliminary Report on Patentability issued in International Patent Application No. PCT/EP2018/066983.

Apr. 23, 2018 French Search Report issued in French Patent Application No. 1700705.

Apr. 23, 2018 Written Opinion on Patentability of the Invention issued in French Patent Application No. 1700705.

* cited by examiner

SHAPED CHARGE

The technical field of the invention is that of shaped charges, that is to say, charges including an explosive load arranged in a casing and a liner applied on the load.

Such shaped charges are well known. Patent FR 2,669,721 thus describes a shaped charge bearing a conical liner (or hollow charge).

Shaped charges are generally designed to be placed in a casing with a well-defined geometry. Most often, the explosive load is poured inside the casing and the liner is glued on a hollow front face of the explosive load.

Patent FR 2,669,721 also proposes means making it possible to compensate for the thermal expansions between the explosive load and the casing. These means comprise an annular filling by a compressible material (for example a polysiloxane elastomer) that is interpoesd between the casing of the shaped charge and the explosive load.

Such an explosive load being mounted in a casing with radial play, the problem arises both of securing the explosive load and the casing and of centering this load.

To resolve these problems, patent EP 1,363,103 describes a shaped charge in which the liner is secured to the casing of the charge by shims that are moved radially by the tightening of screws, so as to be pressed against an inner bearing surface of the casing.

Such a solution has the advantage of allowing simple and reliable securing of the casing and the load while authorizing an adaptation to a casing having a different inner diameter.

However, it has the drawback of requiring multiple tightenings in radial directions, which can be difficult to do (especially for smaller explosive load diameters, for example smaller than 155 mm) and most often requires defining specific tightening means. Furthermore, the tightening tool can interfere with the liner and damage it. It is therefore difficult to ensure the necessary tightening torque for each screw.

It is the aim of the invention to propose a shaped charge not having such drawbacks.

Thus, the shaped charge according to the invention includes means for securing the casing and the explosive load bearing the liner that are simple and reliable and that make it possible to facilitate the assembly operation.

Thus, the invention relates to a shaped charge comprising an explosive load positioned in a casing, a liner applied on the load, and means ensuring the securing of the casing and the load bearing the liner, the securing means comprising a ring having a stop surface for the liner, the shaped charge comprising at least two shims each covering an angular sector, the shims moving radially relative to the ring by the action of a tightening means, to be pressed against an inner bearing surface of the casing, the tightening means comprising at least one screw for each shim, the screw cooperating with a tapped hole arranged in the ring and the end of which pushes the shim during the screwing of the screw, the shaped charge being characterized in that:

said shims are positioned axially relative to the ring by at least one radial pin that is engaged in a radial piercing of the ring and that is housed in a radial hole of said shims, said shims being able to slide on the pin, the tapped hole of the tightening screw(s) also having its axis parallel to the axis of the casing, the screw including a conical end cooperating with a conical bore of said shims, an axial movement of the screw during its screwing leading to a radial movement of said shims.

According to one embodiment, the charge includes, for each shim, a positioning pin positioned at a median plane of the shim and two tightening screws positioned symmetrically on either side of the positioning pin.

Each shim may advantageously include a conical outer profile suitable for cooperating with an inner surface of the casing forming a conical bearing to ensure that the explosive load is axially held relative to the casing.

The ring may include an outer cylindrical profile ensuring the guiding of the ring relative to the casing.

The ring may also include an inner cylindrical seat surrounding an outer rim of the liner.

The charge may include a lock washer interposed between the liner and the stop surface of the ring.

According to one specific embodiment, the charge may include four shims uniformly angularly distributed.

The shims may not cover the entire outer profile of the ring and may be separated by slots.

The charge may include an annular space between the explosive load and the casing, the space being filled with a compressible material.

The invention will be better understood upon reading the following description of one specific embodiment, the description being done in reference to the appended drawings and in which.

Figure 2:
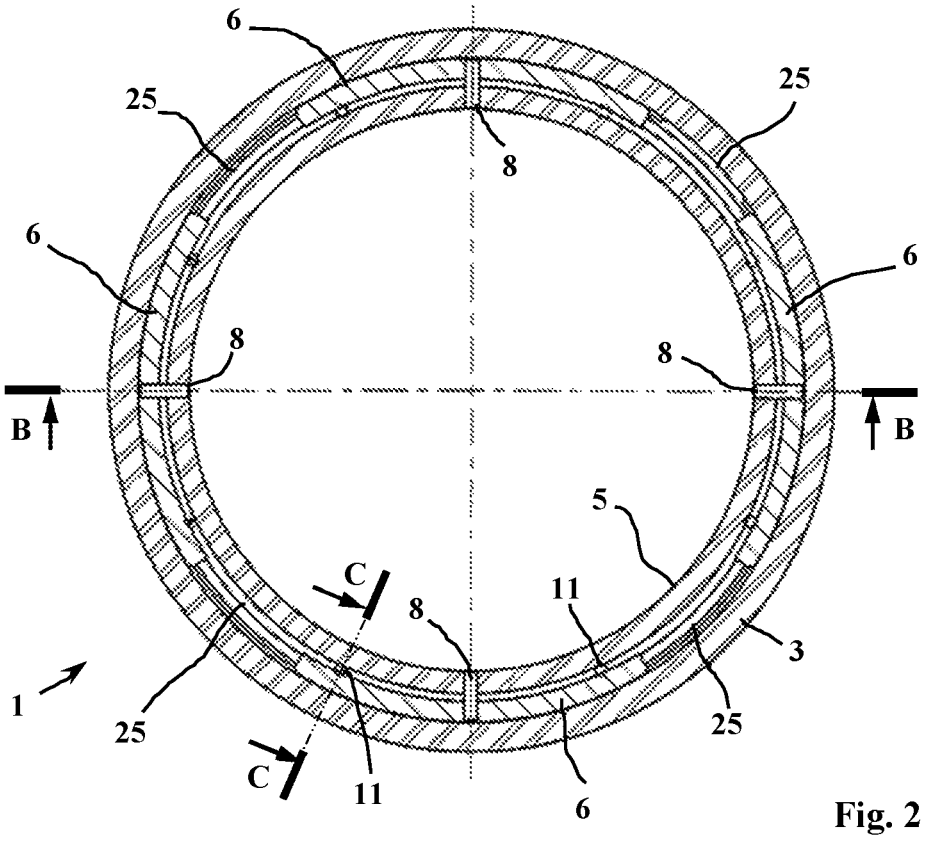
FIG. 2 is a cross-sectional view of this shaped charge, the section being done at the plane whose outline AA is shown in FIG. 1.
Figure 3A:
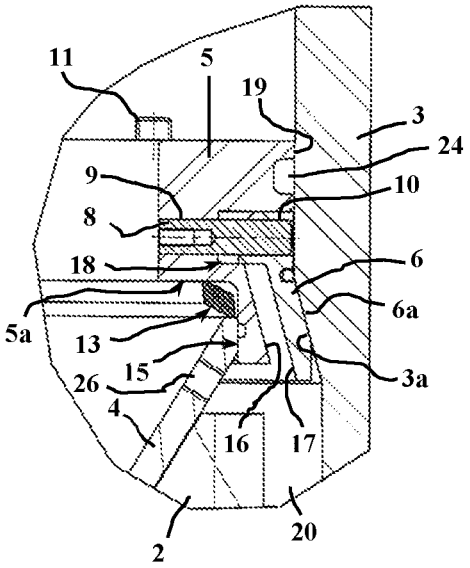
Figure 3B:
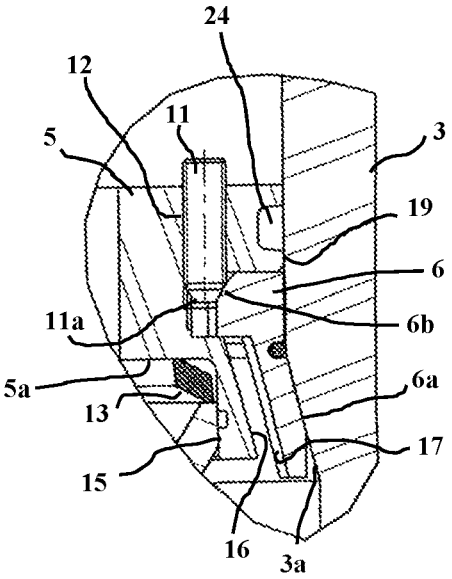

FIG. 3*a* is an enlarged detail view of the securing means, the sectional view being done at a radial positioning axis of a shim, the outline BB of the sectional plane being shown in FIG. 2;

FIG. 3*b* is an enlarged detail view of the securing means, the sectional view being done at a tightening screw, along the section plane whose outline CC is shown in FIG. 2.

Figure 1:
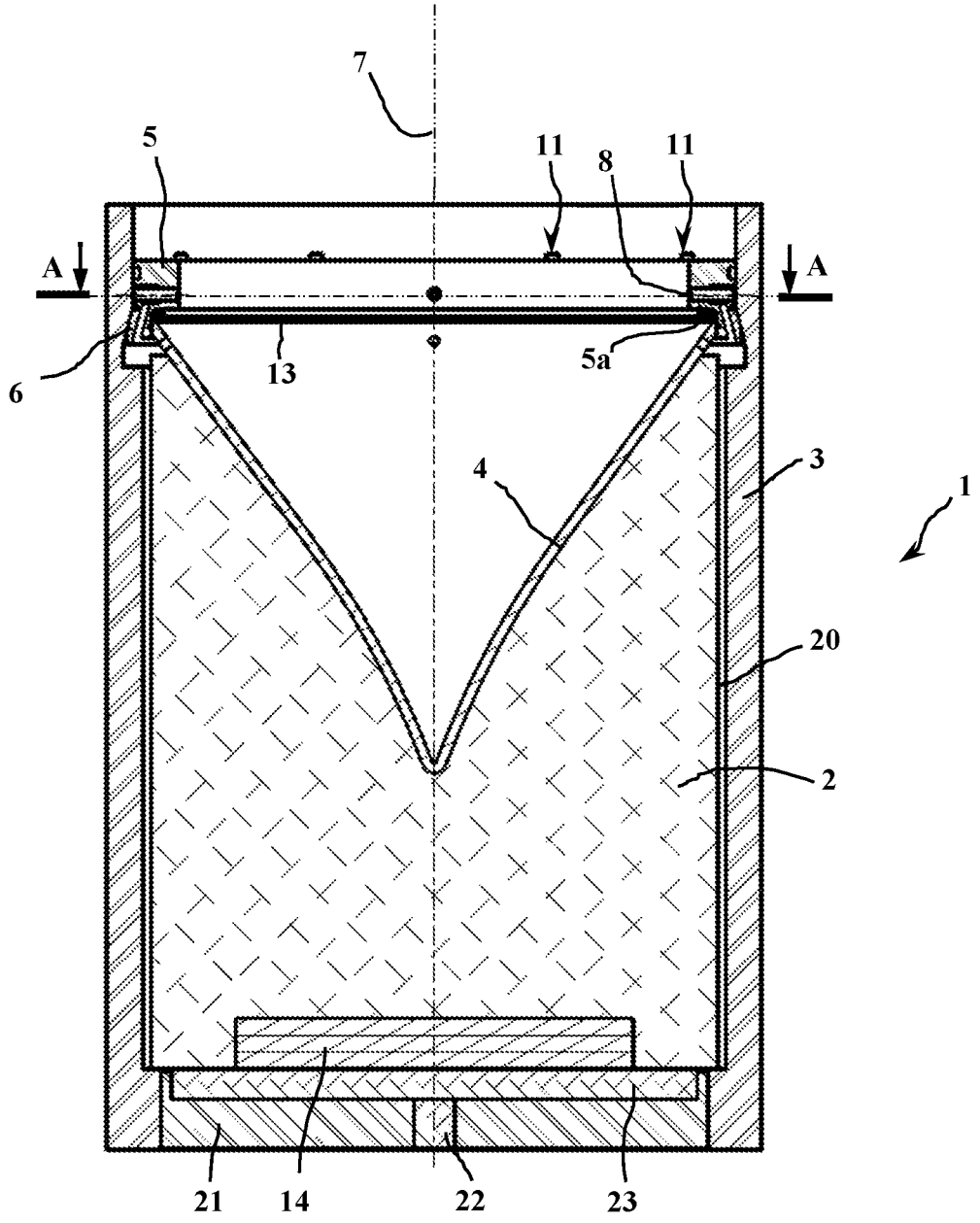
FIG. 1 is a simplified longitudinal sectional view of a shaped charge according to one embodiment of the invention, the section being done at the plane whose outline BB is shown in FIG. 2.

In reference to FIGS. 1 and 2, a shaped charge 1 according to the invention comprises an explosive load 2 that is positioned in a globally cylindrical casing 3 with an axis 7, and also a liner 4, made of a ductile material such as copper, which is applied on the load 2.

The rear part of the casing 3 carries a closing cover 21 that receives priming means, for example a detonator 22 and a relay 23. These means are not part of the invention and are therefore shown very schematically. A detonation wave shaper screen 14 is also shown at the base of the explosive load 2.

This warhead 1 also comprises means ensuring the securing of the casing 3 and the load 2 bearing the liner 4. These securing means comprise a ring 5 having a stop surface 5*a* for the liner and shims 6 that each cover an angular sector. Here, there are four shims 6 that are uniformly angularly distributed (see FIG. 2).

As described by patent EP 1,363,103, the shims 6 can move radially relative to the ring 5 through the action of a tightening means, to be pressed against an inner bearing surface of the casing 3.

More specifically in the embodiment that is described here, each shim 6 includes a conical outer profile 6*a* that is designed to cooperate with an inner surface 3*a* of the casing 3 that forms a conical bearing (see FIG. 3*a*).

This conical shape matching makes it possible to reliably ensure that the explosive load 2 is axially held relative to the casing 3.

Of course, and as described by patent EP 1,363,103, it is possible to give the shims 6 a non-conical outer profile so as to adapt the invention to the geometries of different enclosures 3. If the enclosure 3 has no conical seat 3*a*, it will thus be possible to give the shims 6 a cylindrical outer profile including a knurling or indentations in order to ensure, during the tightening of the shims 6, the catching of the latter on the inner surface of the casing 3, therefore the blocking of the explosive load relative to the casing.

As can be seen in FIG. 3*a*, each shim 6 is positioned axially relative to the ring 5 by at least one radial pin 8 that is engaged in a radial piercing 9 of the ring 5 and that is housed in a radial hole 10 of the shim 6. The shim 6 can slide on the pin 8 to approach the casing 3.

According to this embodiment, there is a single positioning pin 8 on each shim 6, this pin being arranged at a median plane of the shim 6 (see FIG. 2).

The pin 8 can include a threaded rear part that will be engaged in a tapped hole of the ring 5 and a smooth front part that will receive the shim 6.

The tightening means of each shim 6 comprises at least one screw 11 for each shim, here two screws 11 positioned symmetrically on either side of the positioning pin 8 (see FIG. 2), and each tightening screw 11 cooperates with a tapped hole 12 arranged in the ring 5 (see FIG. 3*b*).

According to the invention, the tapped hole 12 of the tightening screws 11 has its axis parallel to the axis 7 of the casing 3 and the screw 11 includes a conical end 11*a* that cooperates with a conical bore 6*b* of the shim 6 (see FIG. 3*b*).

Thus, when the screw 11 turns in its tapped hole 12, its end 11*a* pushes the shim 6. The latter being axially connected to the ring 5 by the pin 8, this axial movement of the screw leads to a radial movement of the shim 6. The conical outer profile 6*a* of the shim 6 comes into contact with the conical inner surface 3*a* of the casing 3. The continued tightening of the screw 11 leads to a relative sliding of the shim 6 along the conical profile 3*a* of the casing. This results in an axial pushing in of the ring 5 bearing the shims 6, which leads to a slight compression of a lock washer 13 that is interposed between the liner 4 and the stop surface 5*a* of the ring 5. Thus, the explosive load 2 and the liner 4 are immobilized relative to the casing 3, but the explosive load 2 retains a possibility of axial deformation by expansion through the compression of the lock washer 13.

The ring 5 includes an outer cylindrical profile 19 ensuring the guiding of the ring 5 with respect to the casing 3. A sealing gasket (not shown) can be positioned in a groove 24 at the outer cylindrical profile 19.

Furthermore, the ring 5 includes an inner cylindrical seat 15 that surrounds an outer rim of the liner 4. Thus, during assembly, the ring 5 is positioned precisely with respect to the liner 4 and the explosive load 2. It can also be noted in FIGS. 3*a* and 3*b* that the ring 5 includes, in its lower part, an outer conical seat 16 that is located across from an inner conical profile 17 that is complementary thereto and that is borne by the shim 6.

The ring 5 lastly includes a peripheral groove 18 (FIG. 3*a*) in which a collar of the shim 6 can penetrate. Thus, when all of the screws 11 are loosened, the shims 6 can slide radially along the groove 18 and be positioned withdrawn with the inner conical profile 17 in contact on the outer conical seat 16. In this position, the maximum outer diameter of the assembly formed by the ring 5 bearing the shims 6 is that of the cylindrical profile 19.

The ring 5 bearing the four shims 6 can therefore be introduced without difficulty inside the casing 3.

Once the load bearing the ring equipped with the shims is in place in the casing, the tightening of the screws 11 will make it possible to secure the load 2 with the casing 3 by the radial sliding of the shims 6.

As one can see in FIG. 2, the shims 6 are separated by axial slots 25. These slots facilitate the passage of electrical wires between the front part of the charge and its rear part. One thus facilitates the connection between a fuze controlling the firing of the charge and the priming means.

As one can see in FIG. 1, an annular space 20 is arranged between the explosive load 2 and the casing 3. This space may be filled with a compressible material (not shown), for example by a tube made of polyurethane foam. Such an arrangement makes it possible to ensure radial shimming of the explosive load 2 relative to the casing 3.

The shimming provides protection of the charge against impacts and also allows a radial expansion of the explosive load 2.

The compressible material may also be an elastomer injected into the annular space as described by patent FR 2,669,721. An elastomer injected into the annular space may also fill the slots 25 and all of the spaces separating the shims 6 and the ring 5. The shimming of the entire assembly is thus completed. The injection of the material will be done through holes 26 made in the liner 4 or holes arranged in the closing cover 21.

The invention claimed is:

1. A shaped charge comprising:

an explosive load positioned in a casing;

a liner applied on the load;

a ring configured to secure the casing to the load bearing the liner, the ring including a stop surface for the liner;

at least two shims each covering an angular sector;

a screw being configured to allow the shims to move radially relative to the ring, the screw being configured to press against an inner bearing surface of the casing, the screw comprising at least one screw for each shim, the screw cooperating with a tapped hole arranged in the ring and an end of the screw pushes the shim during the screwing of the screw, wherein:

the shims are positioned axially relative to the ring by at least one radial pin that is engaged in a radial piercing of the ring and that is housed in a radial hole of said shims, said shims being able to slide on the radial pin, the tapped hole arranged in the ring having a first axis that is parallel to a second axis of the casing, the screw including a conical end cooperating with a conical bore, an axial movement of the screw during its screwing leading to a radial movement of the shims.

2. The shaped charge according to claim 1, wherein the shaped charge includes, for each shim, one of the at least one radial pin positioned at a median plane of the shim and two tightening screws positioned symmetrically on either side of the radial pin.

3. The shaped charge according to claim 1, wherein each shim includes a conical outer profile suitable for cooperating with an inner surface of the casing forming a conical bearing to ensure that the explosive load is axially held relative to the casing.

4. The shaped charge according to claim 1, wherein the ring includes an outer cylindrical profile ensuring guiding of the ring relative to the casing.

5. The shaped charge according to claim 4, wherein the ring includes an inner cylindrical seat surrounding an outer rim of the liner.

6. The shaped charge according to claim 1, wherein the shaped charge includes a lock washer interposed between the liner and the stop surface of the ring.

7. The shaped charge according to claim 1, wherein the at least two shims includes four shims uniformly angularly distributed.

8. The shaped charge according to claim 1, wherein:

the shims do not cover an entire outer profile of the ring; and the shims are separated by slots.

9. The shaped charge according to claim 1, wherein the shaped charge includes an annular space between the explosive load and the casing, the space being filled with a compressible material.

* * * * *